United States Patent [19]

Rao et al.

[11] 4,315,972

[45] Feb. 16, 1982

[54] CASTING WHOSE MOLDING TAKES PLACE DURING ITS RECOVERY BY MEANS OF FILTRATION-DEHYDRATION

[75] Inventors: Chatty Rao, Bensberg-Refrath; Hans Bender, Leverkusen, both of Fed. Rep. of Germany

[73] Assignee: Klockner-Humboldt-Deutz AG, Fed. Rep. of Germany

[21] Appl. No.: 806,530

[22] Filed: Jul. 18, 1977

Related U.S. Application Data

[63] Continuation-in-part of Ser. No. 805,011, Jun. 9, 1977, abandoned.

[30] Foreign Application Priority Data

Jun. 14, 1976 [DE] Fed. Rep. of Germany ..... 2626603

[51] Int. Cl.[3] ..... C22B 1/14; C22B 1/16; C22B 1/22; B32B 9/04

[52] U.S. Cl. ..... 428/542; 75/3; 75/5; 75/256; 249/117; 249/174; 75/41; 428/576; 428/2

[58] Field of Search ..... 428/542, 148, 516, 566, 428/539; 264/109, 111, 117, 125; 75/3, 5, 41; 249/117, 174; 106/38.3

[56] References Cited

U.S. PATENT DOCUMENTS

| | | | |
|---|---|---|---|
| 3,254,867 | 6/1966 | Harvey et al. | 249/174 |
| 4,032,104 | 6/1977 | Pepin | 249/174 X |

FOREIGN PATENT DOCUMENTS

| | | | |
|---|---|---|---|
| 1483574 | 2/1971 | Fed. Rep. of Germany | 249/174 |
| 408825 | 9/1966 | Switzerland | 249/117 |

*Primary Examiner*—Marion McCamish
*Assistant Examiner*—Alexander S. Thomas
*Attorney, Agent, or Firm*—Hill, Van Santen, Steadman, Chiara & Simpson

[57] ABSTRACT

A casting consisting of a dehydrated agglomerate of particulate material and shaped such that one of its right angle projections is in the form of a trapezoid whose sides include angles greater than 90°, the sides being joined by means of curved surfaces.

8 Claims, 7 Drawing Figures

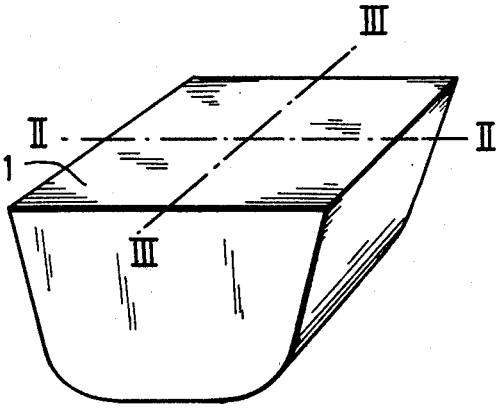
FIG.1
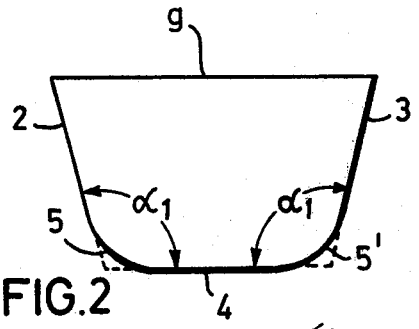
FIG.2
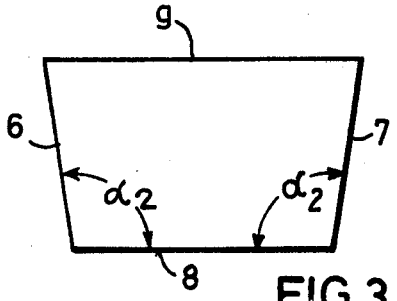
FIG.3
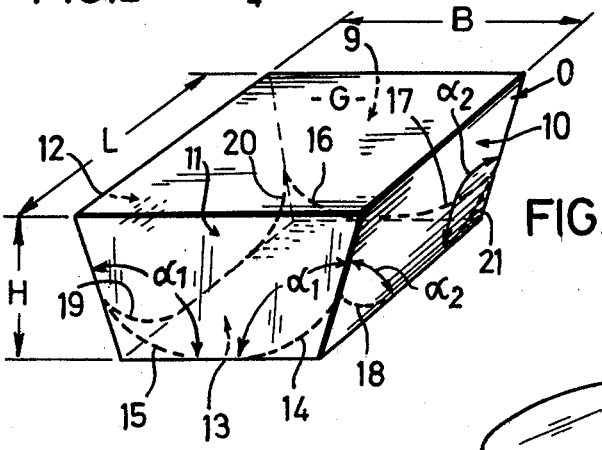
FIG.4
FIG.5
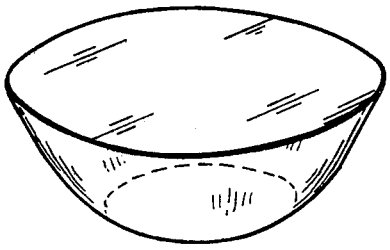

CASTING WHOSE MOLDING TAKES PLACE DURING ITS RECOVERY BY MEANS OF FILTRATION-DEHYDRATION

This application is a continuation-in-part of our copending application entitled "Casting whose molding takes place during its recovery by means of filtration-dehydration", filed June 9, 1977, U.S. Ser. No. 805,011, abandoned.

The invention relates to a casting whose molding takes place during its recovery through filtering-dehydration from a sludge-type solids/liquid-mixture, particularly ore-sludge from preparation-installations, in an elastic mold-grid containing the molding-negative.

The production of castings from iron ore sludge by means of filtration-dehydration is known (German Laid Open Specification No. 1,920,219). In this connection, use is made of small, relatively solid particles of a desired grain-size, which are box-shaped or may have any other desired shape, and whose dimensions are adapted to the conditions of the sintering process, for example, circa 1 to 5 mm. thick and of approximately 5 to 15 mm. edge-length. It is also known to prepare dried filter cakes recovered from ore sludge into a gas-permeable sintering mixture (German Laid Open Specification No. 1,925,876) in that the latter are crumbled into preferably approximately cube-shaped iron ore particles in the size of about 10 to 20 mm.

In the castings thus produced, however, no concrete requirements are made as to the molding, because apparently its importance as well as the importance of the correlation between molding and function previously had not been sufficiently recognized.

This correlation, however, is of importance, because the molding in combination with the absolute size of the individual castings, both on account of the production process as well as also on account of the utilization in a pyrometallurgical process, has to fulfill an important function.

Thus for example, the recovery through filtering dehydration requires a form of casting which is necessary for the dehydration process.

Dependent on the production is also the necessity of a form through which the casting is put in position to be released easily and without damage at the end of the recovery process from the elastic mold-grid. A further connection between mold and function of the individual casting results from the requirement that a heap of raw ore formed of castings, be it upon a subsequent sintering on a sinter belt or upon subsequent entry into a pyrometallurgical process, has to possess a predetermined minimum gas-permeability. Further, the sensitivity to wear of the individual particles both upon transportion as well as also in the heap of raw ore, is appreciably influenced through the formation of the individual castings. And finally, it must be taken into consideration that the form of the individual castings has influence on a more or less space-utilizing rational arrangement in the mold-grid, and therewith, is of importance for the optimal use of the filter surface as well as for the duration and the loadability of the mold-grid.

The object of the invention consists therein, namely, to form a casting of the aforementioned type, so that the partially conflicting requirements are fulfilled to as fargoing an extent as possible.

This is attained with the invention thereby, that at least one projection of the casting on a plane approximately perpendicular to the surface of the filter has approximately the shape of a trapezoid, whose sides, which enclose an angle $\alpha$ greater than 90° pass over into one another with a curvature. In this connection, the curvature may be part of a conical section, for example, a circle, an ellipse, a parabola, a hyperbola or a similar one.

A favorable formation of the casting results if the latter has the basic shape of an obelisk.

It was found, quite surprisingly, that this basic shape in the case of a heap of raw ore results in the least resistance to the gas-flow-through.

By the expression "Obelisk" is understood, according to the engineering notebook "Hutte" (Metallurgical Plant), Vol. I, 25th Edition, 1925, page 17, at the top,—a body which has approximately the shape of a truncated pyramid. In the sense of the invention, by the expression "Obelisk" is also understood a very flat truncated pyramid.

In this connection, the casting may also be so constructed that the angles $\alpha_1$; $\alpha_2$ which are greater than 90°, deviate from one another in the different projections.

Thus, the angles $\alpha_1$; $\alpha_2$ amount to between 95° and 110°, preferably 100° to 105°.

The casting according to the invention, may, however, also have a basic shape with an outline deviating from the rectangular shape, whereby the outline is for example a 5, 6, 8 sided polygon, preferably a hexagon.

Also this form-outline is functionally of importance. For, a multi-angular body has the advantage, that its truncated edges are less sensitive to wear. A hexagonal body has beyond this advantages with reference to an optimal geometrical joining together of several bodies in honeycomb shape on the surface of the mold band, whereby the degree of utilization of this surface as well as the pertaining filter is very favorable.

The blank or casting may, however, also possess the basic shape of a rotation-symmetrical body.

In this case, its wear-behavior is good, however, the utilization of the filter- and mold-band-surface is relatively unfavorable. It must be decided in practice, therefore, from case to case, for example, depending on the nature of the slurry, which according to the invention best fulfills the particular functional requirements as to shape of the casting.

Finally, the casting possesses, according to the invention, a thickness between 3 and 25 mm., preferably 6 to 12 mm., and the edge length measured perpendicularly to the thickness amounts to between 5 and 30 mm., preferably 10 to 20 mm.

This absolute size of the casting influences the gas-permeability of a heap of raw ore formed out of castings. Upon decreasing individual size, the resistance increases for the gas-passage, while with increasing individual size, the resistance decreases.

On the other hand, however, a casting recovered through filtering-dehydration, subsequently dried, must not be too large, because shrinkage cracks set in, which jeopardize the durability of the casting. Also the breakage- and wear-behavior of the casting, for example during conveyor transport, upon reaching discharge points, etc., is worsened appreciably with increasing individual size of the casting.

Some embodiments by way of example are explained on the basis of the attached drawings.

In the drawings:

FIG. 1 is a casting according to the invention, in perspective.

FIG. 2 is a view of a projection of the casting in one plane of projection.

FIG. 3 the view of a projection of the casting in another plane of projection.

FIG. 4 is the basic form of a casting in the shape of an obelisk in perspective.

FIG. 5 is a casting with the basic shape of a rotation-symmetrical body, in perspective.

Figure 6:
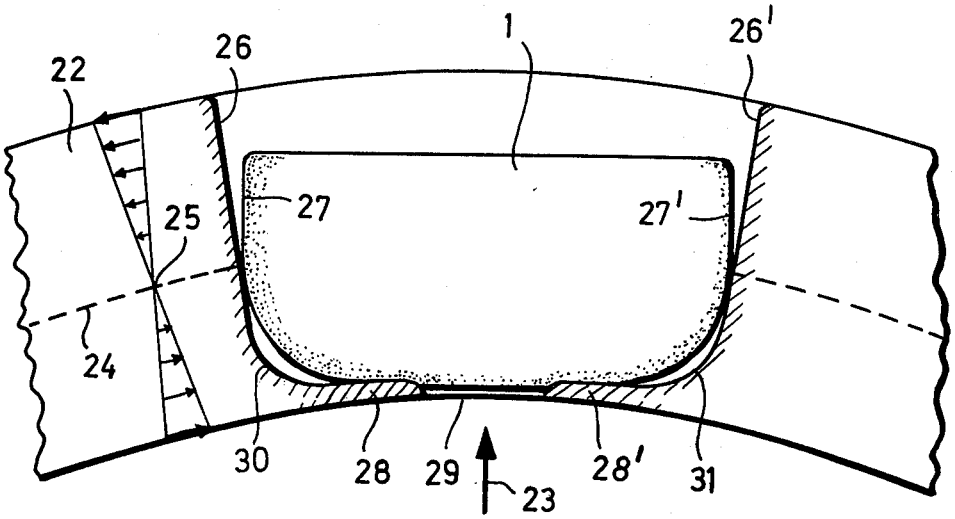
Figure 7:
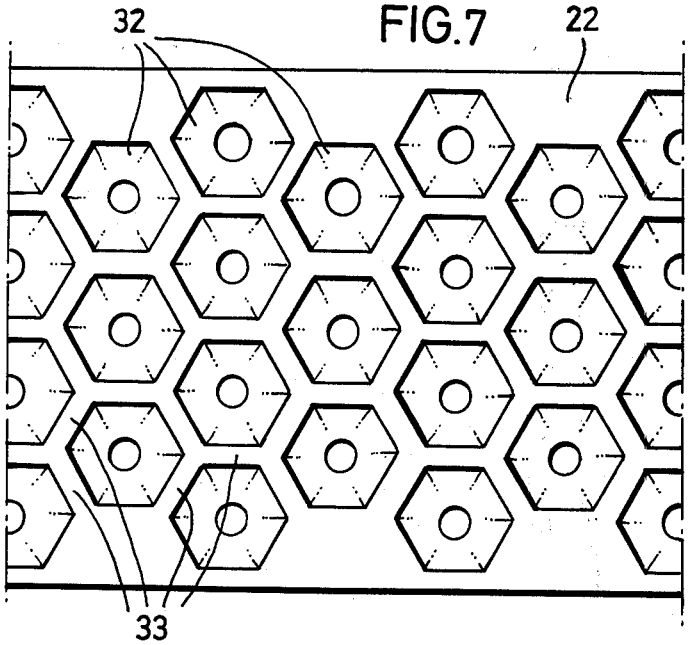

FIG. 6 illustrates the lifting of the casting out of the mold-grid in cross-section;

FIG. 7 illustrates an arrangement of several mold negatives with hexagonal outline in the mold-cavities in plan view.

FIG. 1 shows a preferred shape of the casting 1 according to the invention. The latter shows in a plane of projection which is imagined extending perpendicularly to the line III—III and parallel to the line II—II, the shape of a trapezoid, as this is shown in greater detail in FIG. 2. The trapezoid in FIG. 2 standing on its head consists of a flat side g as well as the sides 2, 3 and 4. The sides 2/4 and 3/4 each define an angle $\alpha_1$, which is greater than 90°. In this connection, the sides 2, 3 and 4 enclosing this angle $\alpha_1$ merge into one another with the curvatures 5, 5'.

Another projection of the casting imagined in a second plane of projection perpendicularly to the line II—II, parallel to the line III—III is shown in FIG. 3. This projection has the shape of a trapezoid with the flat side g and the sides 6, 7, 8. The sides 6, 8 as well as 7, 8 merge into one another with the angle $\alpha_2$, which is larger than 90°, however, smaller than the angle $\alpha_1$.

FIG. 4 shows the basic shape of a casting, an obelisk O (standing on its head).

The expression "basic shape" refers to a pre-stage of the shape according to the invention, from which the casting proceeds through the specific features to provide the shape of the invention.

With the obelisk there results for example first a casting through application of the transition curvatures of the surfaces enclosing an angle $\alpha_1$ or $\alpha_2$ greater than 90°. In the case of the "basic shape", there is provided a truncated-pyramid-shaped body with the height H whose basal surface G has the width B and the length L. The obelisk additionally consists of the side surfaces 9, 10, 11, 12 and the closure surface 13.

In each case, at least one pair of surfaces 10, 12 encloses with the closure surface 13 an angle $\alpha_1$ greater than 90°. Correspondingly, also the side surfaces 9, 11 enclose with the surface 13, each an angle $\alpha_2$, which likewise is greater than 90°. The angles $\alpha_1$ and $\alpha_2$ may in this connection be equal or different from one another.

From the basic form of the obelisk according to FIG. 4, as stated, the casting results thereby that in each case, pairs of surfaces 10/12 and the closure surface 13 with curvatures 14, 15, 16, 17 merge into one another. Correspondingly, also the pairs of surfaces 9, 11 merge into one another by means of curvature 18, 19, 20, 21, whereby for example, a two-dimensional rounding off of the transition of the side surfaces 9, 10, 11, 12 with the closure surface 13 results.

A casting with the basic shape of a rotation-symmetrical body is shown in FIG. 5. Its projection into a plane parallel to the rotation-axis of symmetry corresponds likewise to the shape of a trapezoid, according to the showing in FIG. 2.

In FIG. 6 is seen the casting 1 at the moment of its loosening from the elastic mold 22. This occurs, for example, when the elastic mold 22 makes a forced bending along the radius 23, for example about a guide roller. Thereupon, the elastic band expands above the neutral axis 24, which is indicated as dotted line, while it is compressed below the neutral axis 24, as is shown in principle with the arrow arrangement 25.

Thereupon, the following occurs:

While the sides 26, 26' of the elastic mold 22 disengage from the sides 27, 27' of the casting 1, the lower surfaces 28, 28' of the elastic mold 22, on account of the curvature of the band exert a lever-type pressure against the under side of the casting 1, which is thereby pressed out of the mold.

In this manner, the form of the casting supports in cooperation with the counterpart form of the mold, the ejection of the casting 1 from the elastic mold 22. A dehydration hole in the mold 22 is indicated by 29. It was surprisingly found that the dehydration operation is only slightly influenced by the relation of the size of the dehydration hole 29 to the size of the casting 1. To the contrary, the important aspects are the rounded corners 30, 31 in the mold negative, or on the casting, respectively, because the latter appreciably influence in a favorable way the dehydration operation, as was likewise surprisingly found.

In FIG. 7 is finally shown a piece of mold band 22 which has molds 32 for the production of castings with hexagonal outline.

The illustration is to show that the alignment of individual molds 32 in a honeycomb-shaped design brings with it a particularly favorable use of the band surface, whereby through the network-type connecting steps 33 of the band 22, a sufficient strength is achieved in the direction of pulling.

Example:

For a corroboration of the statements made in the above-named patent application, dehydration tests were carried out in a vacuum drum filter with the following drum dimensions:

Drum diameter:
1055 mm
Filter surface:
6 $m^2$ (divided into 20 cells)
Filter speed:
1 rpm (0.5–3.0 rpm, continuously regulable).

A normal filter cloth which is customary in iron ore dehydration was stretched over the filter drum. The shaping means, a form band consisting of polyurethane synthetic material, was placed on the filter cloth. The thickness of the form band is adapted to the thickness of the pellet to be produced. The dimensions of the individual honeycombs within the form band, which also correspond to the geometry of the iron ore pellet to be produced, are: (See FIGS. 1 to 4)

Honeycomb dimension at top:
L; B 16.7 mm)
Honeycomb dimension at bottom:
L; B 8.9 mm) Average value—12.8 mm
Honeycomb dimension at bottom:
L; B 10.0 mm (Broken line, FIG. 2)
Radius at bottom
2 mm
$\alpha_1$; $\alpha_2$ 105 degrees (FIGS. 2 and 3)
Degree of filling
40%

Honeycomb thickness
H 12.5 mm

In the selection of the honeycomb geometry, the following criteria played the most important role:

The constructional design of the synthetic material band (solidity, hardness, expansion, etc.)

The optimum honeycomb filling during intake

The detachability of the moldings out of the honeycomb form after dehydration without abrasion or adhesion of the ore particles to the synthetic material walls The maximum possible open filter surface of the honeycomb band, based on the above-mentioned requirements The pellet abrasion in the green state and after the firing of the pellet The metallurgical necessity of the pellet size (the standard dimensions are around 6–14 mm diameter) taking into consideration the flow behavior in the blast furnace shaft.

For the production of moldings with the above cited geometry, tests were carried out with a Russian magnetite ore (so-called Kovdorsky concentration) with the preparation of an ore slurry. The slurry density amounted to 2600 g of solid matter/liter of ore slurry, i.e., about 80 weight % solid matter and about 20 weight % of water. Granulation analysis of the ore:

Fraction 4μ
35 weight %
Fraction 40–200μ
55 weight %
Fraction 200–500μ
10 weight %

The moisture content of the pellets produced after the dehydration amounted to about 8%, and the green strength about 1 P per pellet. The pellets were subsequently transported on a roller transporter consisting of several rollers where the green strength increased by about 80%. The abrasion values of the green pellets, i.e., fraction under 6 mm, amounted to about 10%.

In our tests, no disadvantageous effect on the dehydration behavior of the iron ore is to be determined as a result of alteration of the pellet geometry.

We claim:

1. A casting consisting of a dehydrated agglomerate of a particulate metal ore material having a shape such that it has at least one projection in a plane perpendicular to its major dimension in the form of a trapezoid whose sides which include angles greater than 90° are joined by means of a curved surface, said casting having a thickness between 3 and 25 mm. and an edge length measured perpendicular to the thickness between 5 and 30 mm.

2. A casting according to claim 1 having a thickness between 6 and 12 mm., and an edge length measured perpendicular to the thickness amounting to 10 to 20 mm.

3. A casting according to claim 1 in which said curved surface is a conic section.

4. A casting according to claim 1 shaped essentially as a truncated pyramid.

5. A casting according to claim 1 in which another projection of said casting has angles greater than 90°, which angles are different from the first-mentioned angles.

6. A casting according to claim 5 in which both sets of angles are in the range from 95° to 110°. pg,13

7. A casting according to claim 1 having an outline of polygonal shape and having more than four sides.

8. A casting according to claim 1 having an outline of a surface of revolution.

* * * * *